US007793435B1

(12) United States Patent
Ruth

(10) Patent No.: US 7,793,435 B1
(45) Date of Patent: Sep. 14, 2010

(54) ARTICLE OF FOOTWEAR HAVING AN INTEGRATED SUPPORT SYSTEM

(75) Inventor: Rob Ruth, Canton, MA (US)

(73) Assignee: Reebok International Ltd., Canton, MA (US)

( * ) Notice: Subject to any disclaimer, the term of this patent is extended or adjusted under 35 U.S.C. 154(b) by 779 days.

(21) Appl. No.: 11/733,741

(22) Filed: Apr. 10, 2007

(51) Int. Cl.
*A43C 11/00* (2006.01)

(52) U.S. Cl. ..... 36/50.1; 36/59 R

(58) Field of Classification Search ..... 36/50.1, 36/59 R, 59 C, 73, 74, 75 R
See application file for complete search history.

(56) References Cited

U.S. PATENT DOCUMENTS 5,410,821 A * 5/1995 Hilgendorf ..... 36/100
5,692,319 A * 12/1997 Parker et al. ..... 36/50.1
5,937,545 A * 8/1999 Dyer et al. ..... 36/35 R
6,789,332 B1 * 9/2004 Scholz ..... 36/27
7,100,310 B2 * 9/2006 Foxen et al. ..... 36/29
7,331,123 B2 * 2/2008 Workman et al. ..... 36/15
2005/0126042 A1 * 6/2005 Baier et al. ..... 36/50.1
2008/0010854 A1 * 1/2008 Sokolowski ..... 36/8.3
2009/0044428 A1 * 2/2009 Bernardeschi ..... 36/103

* cited by examiner

*Primary Examiner*—Ted Kavanaugh
(74) *Attorney, Agent, or Firm*—Sterne, Kessler, Goldstein & Fox P.L.L.C.

(57) ABSTRACT

Articles of footwear having integrated support structures and methods for producing them. A support structure is formed by finger-like extensions of the upper material that are wrapped around at least the midfoot region of the outer surface of the midsole of the article of footwear to at least partially form a ground engaging surface of the article of footwear. The portions of the shoe upper that wrap around the midsole may have a layer of injected TPU material thereon to form an outsole of the article of footwear. Shoelace eyestays may extend through the top portion of the support structures so that when a wearer wishes to tighten the shoelaces, the entire support structure tightens around the periphery of the upper and sole of at least the midfoot region of the article of footwear.

20 Claims, 4 Drawing Sheets

ARTICLE OF FOOTWEAR HAVING AN INTEGRATED SUPPORT SYSTEM

BACKGROUND OF THE INVENTION

1. Field of the Invention

The present invention generally relates to footwear, and more particularly to methods for constructing an article of footwear and products manufactured according to such methods.

2. Background Art

Typically, a shoe, such as an athletic shoe, includes an upper and a sole. The upper is that part of the shoe which covers and protects the heel, instep, toe and side portions of the foot. The upper is secured to the wearer's foot by a closure system which typically includes a lacing means, buckles, or hook and loop-type fasteners, such as VELCRO fasteners. The closure system of the upper is conventionally positioned above the instep portion of the foot to allow easy donning and doffing of the shoe. The sole of an athletic shoe typically includes an insole, a midsole, and an outsole.

The insole (or insole board) typically lies under a removable sockliner. The insole is the foundation of the shoe to which the upper is lasted and the sole attached.

The midsole lies between the insole and the outsole. The primary function of the midsole is to provide cushioning to the wearer's foot, specifically in the heel and forefoot regions. The midsole may be formed in one or more pieces and is the portion of the shoe that provides most of the cushioning upon impact. A mechanism for stabilizing the heel of the foot may also be incorporated into the midsole. While recent years have brought many variations to midsole design, the principal materials used to supply cushioning include polyurethane (PU) and ethylvinyl acetate (EVA) foams.

The outsole is that part of the shoe which comes into direct contact with the ground and is the ground engaging portion of the shoe. As such, the outsole is typically made of an abrasive resistant material such as rubber. Because it is critical that the outsole exhibit certain wear resistant characteristics, there are a finite number of materials from which to make an outsole.

Conventionally, a midsole and an outsole are molded as separate components and then are glued and pressed together to form the sole of a shoe. The upper and the sole are then glued and pressed to the lasted upper to complete the shoe.

Each time the shoe of a runner contacts the ground, considerable force is transmitted through the shoe to the runner's foot. This force tends to push the foot forward in the shoe, causing discomfort. In addition, lateral forces cause relative lateral movement between the foot and the shoe. These lateral forces not only produce fatigue in the runner's foot, but also tend to stretch and wear the shoe, particularly in the metatarsal region. Also, the lateral forces can offset the upper part of the shoe from the sole such that the runner's foot is not properly aligned over the sole.

It is desired, therefore, to provide an athletic shoe with lateral and medial reinforcements which provide additional support on the sides of the foot and which, at the same time, have long life and do not restrict or cause discomfort to the wearer during vigorous and prolonged use.

BRIEF SUMMARY OF THE INVENTION

Described herein are articles of footwear having integrated support structures and methods for producing them.

In one aspect of the invention a method for producing an article of footwear includes forming an upper having at least one support segment on at least either the medial or lateral side of the upper. The support segment terminates in at least one free end. A midsole is attached to the upper and the support segment is wrapped around at least a portion of the midsole. Finally, the free end of the support segment is secured to an outer surface of the midsole. The support segment forms a portion of a ground engaging surface of the article of footwear. The method may further include injection molding a thermoplastic urethane material on at least a portion of the support segment prior to attachment to the midsole. In one embodiment, the support segment has an upper portion and an outsole portion and the thermoplastic urethane material is injection molded on at least a portion of the outsole portion of the support segment and/or on at least a portion of the upper portion of the support segment.

In another aspect of the invention an article of footwear includes an upper, wherein the upper has at least one support segment on at least either the lateral and medial side of the upper. The upper and the support segment or segments are monolithic or made of multiple materials and each support segment terminates in at least one free end. A midsole is attached to the upper; wherein the at least one support segment wraps around at least a portion of the midsole and is secured to an outer surface of the midsole. The support segment or segments form at least a portion of a ground engaging surface of the article of footwear.

In yet another aspect of the invention an article of footwear includes an upper, wherein the upper has at least one support segment on each of the lateral and medial sides of the upper. The upper and the support segments may be monolithic or made of multiple materials and each support segment terminates in at least one free end. A midsole is attached to the upper; wherein the medial and the lateral support segments wrap around at least a portion of the midsole so that the free ends are adjacent each other and are secured to an outer surface of the midsole. The support segments form at least a portion of a ground engaging surface of the article of footwear. The free ends of the medial and the lateral support segments may be adjacent each other along the longitudinal axis of the midsole, along a side of the midsole or at other locations along the midsole.

A thermoplastic urethane material may be injection molded onto at least a portion of at least one support segment. For example, the at least one support segment may have an upper portion and an outsole portion and the thermoplastic urethane material may be injection molded on at least a portion of the outsole portion of the at least one support segment and/or on at least a portion of the upper portion of the at least one support segment. The article of footwear may further include a shoelace eyestay extending through a top portion of at least one of the support segments.

Further, at least one support segment may have an upper portion and an outsole portion and at least a portion of the outsole portion of the at least one support segment may be die cut to form a finger shaped projection from the upper portion of the at least one support segment. The midsole may have at least one indentation adapted to fit the finger shaped projection from the upper portion of the at least one support segment and the finger shaped projection of the at least one support segment may be secured to the indentation in the midsole. The finger shaped projection from the upper portion of the at least one support segment may wrap around at least a portion of a bottom surface of the midsole or the finger shaped projection from the upper portion of the at least one support segment may wrap around the entire bottom surface of the midsole.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

The present invention is now described with reference to the figures where like reference numbers indicate identical or functionally similar elements. While specific configurations and arrangements are discussed, it should be understood that this is done for illustrative purposes only. A person skilled in the relevant art will recognize that other configurations and arrangements can be used without departing from the spirit and scope of the invention.

The following examples are illustrative, but not limiting, of the methods of the present invention. Other suitable modifications and adaptations of the variety of conditions and parameters normally encountered in the field, and which would be apparent to those skilled in the art, are within the spirit and scope of the invention.

Figure 1:
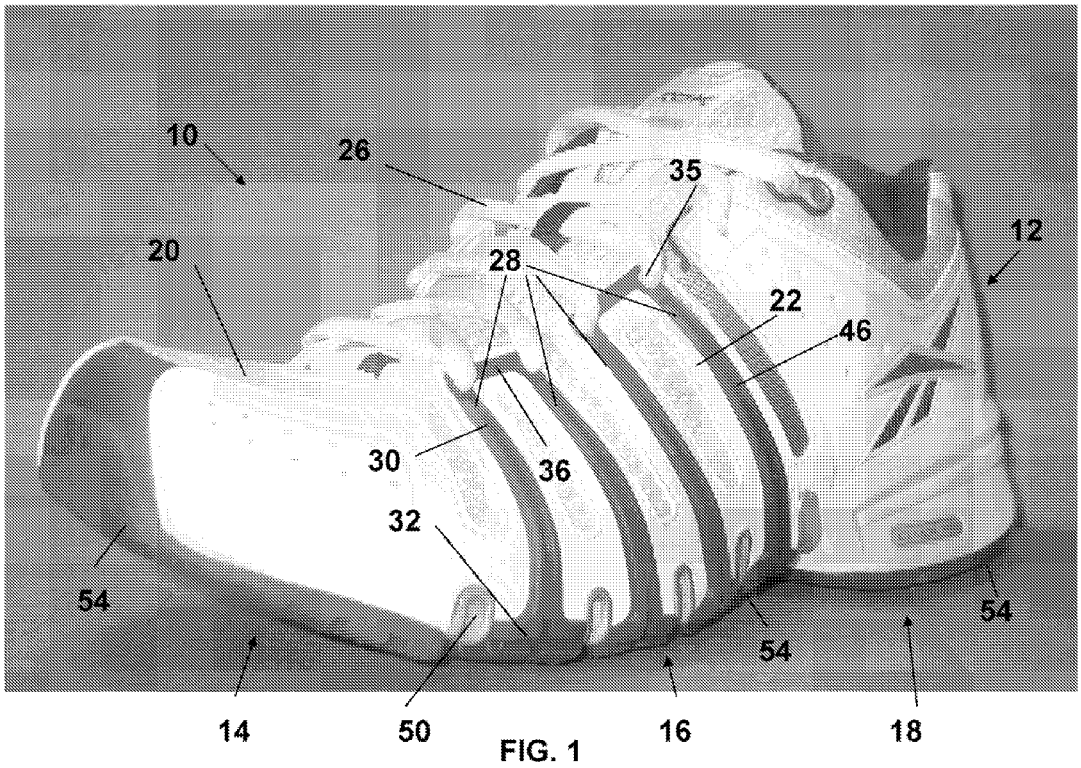
FIG. 1 is a forward-lateral perspective view of a shoe constructed according to the present invention.
Figure 2:
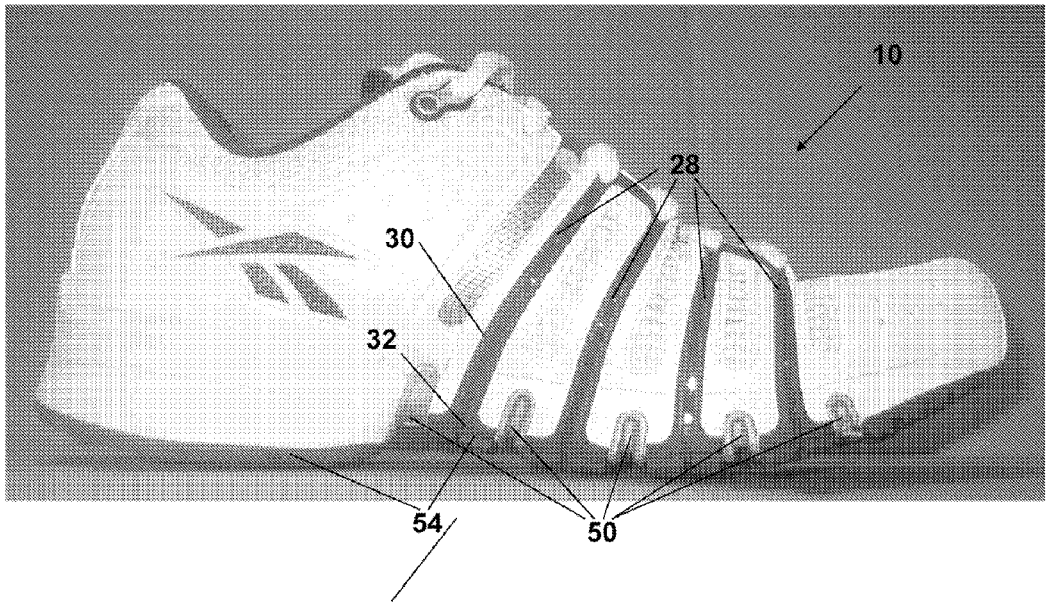
FIG. 2 is a perspective view of the medial side of the shoe of FIG. 1.
Figure 3:
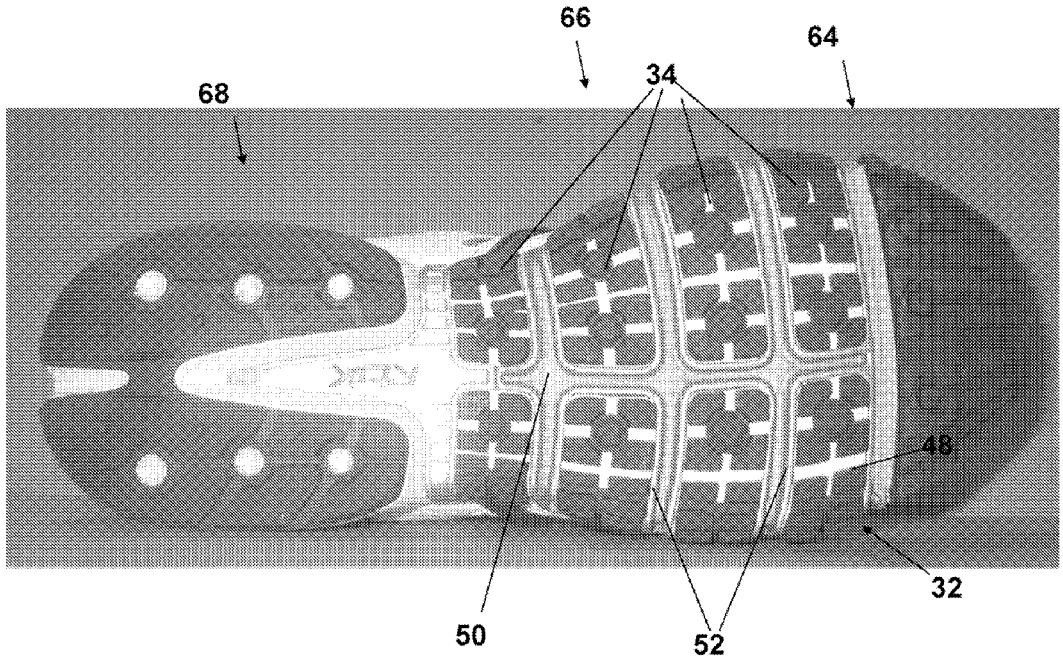
FIG. 3 is a bottom view of the shoe of FIG. 1.

Referring to the drawings and in particular to FIGS. 1-3, an exemplary embodiment of an article of footwear, in particular a shoe, according to the present invention generally referred to by reference numeral 10 is shown. Although shoe 10 is for the left foot, it is understood that a corresponding right shoe would be a mirror-image of shoe 10 and therefore need not be further described. Shoe 10 has a forefoot portion 14, a midfoot portion 16, and a heel portion 18. Shoe 10 has an upper 12, a midsole 50 and an outsole 54. In the embodiment of FIGS. 1 and 2, there are four support segments 28 located generally in midfoot portion 16 on each of the medial and lateral sides of shoe 10. Shoelaces 26 are threaded through eyestays 35 which are near the top of support segments 28. When a wearer tightens shoelaces 26, the tension produced is transferred to support segments 28 which causes shoe 10 to fit snugly and comfortably to the wearer's foot. As will be discussed, support segments 28 nearly completely envelope the periphery of at least the midfoot portion 16 of shoe 10. An unfinished shoe according to a second embodiment is shown in FIG. 4.

Each support segment 28 has an upper portion 30 and an outsole portion 32. Adjacent upper portions 30 can be connected by horizontal portions 36, as in FIG. 1, but in other embodiments can lack horizontal portions, as is shown in FIG. 4. In certain embodiments, upper 12 comprises a base mesh material 20 with various synthetic panels attached through either conventional stitching or other techniques. The upper portion 30 and outsole portion 32 of support segments 28 comprise a base layer of synthetic material 22 with areas of thermoplastic urethane (TPU) injected thereon. However, the present invention is not limited to synthetic materials. For example, TPU can be injected directly on a mesh material or other suitable materials. The TPU areas of support segments 28 resemble an oar, with a handle part 46 and a paddle part 48. There can also be a strip of TPU on optional horizontal part 36, as shown in FIG. 1. The TPU layer of paddle part 48, which will form at least a part of outsole 54, can comprise a tread pattern.

Figure 4:
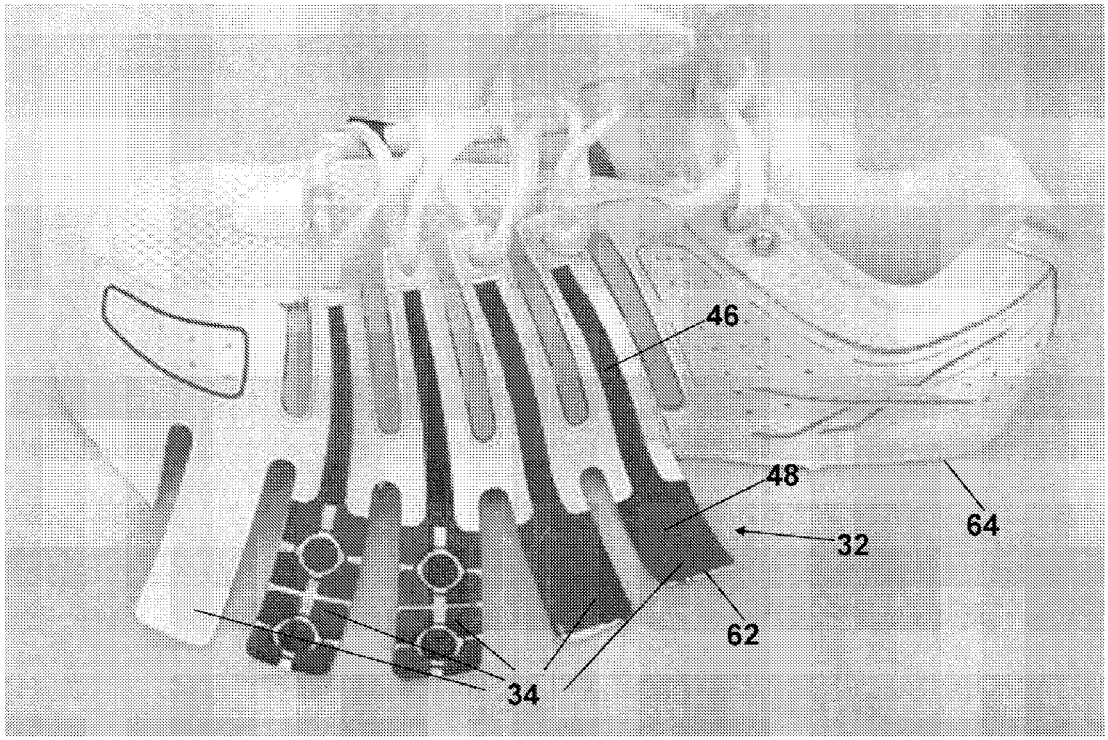
FIG. 4 is a top-lateral perspective view of an alternate embodiment of an upper according to the present invention.

As is best seen in FIG. 4, outsole portions 32 of support segments 28 extend downward beyond the rest of the upper. The downwardly extending material is die cut to form extensions or fingers 34. Each finger 34 terminates in a free end 62. Both the medial and lateral sides of shoe 10 have substantially similar support segments 28, however the fingers may be of the same or different lengths. During the assembly process, upper 12 is placed on a last and a strobel board or insole board (not shown) is attached at the lower periphery 64 of upper 12, leaving fingers 34 free. Next midsole 50 is attached to upper 12. The primary function of midsole 50 is to provide cushioning to the wearer's foot. Suitable materials include polyurethane (PU) and ethylvinyl acetate (EVA) foams. Glue or suitable adhesives are applied to midsole 50. The midsole 50 is aligned with upper 12 before the glue is set and a hydraulic press or other suitable means ensure a tight bond. As best seen in FIG. 3, midsole 50 has indentations 52 which are adapted to fit fingers 34. Glue or suitable adhesives are applied to fingers 34 before the fingers are fit into indentations 52. A hydraulic press or other suitable means is used to ensure a tight bond between fingers 34 and midsole 50.

As best seen in FIG. 3, portions of midsole 50 are visible between fingers 34 of outsole 54. In the embodiment shown, the midfoot portion 66 of outsole 54 is comprised by the fingers 34 of support segments 28. The free ends 62 of the medial and lateral support segments 28 are adjacent to each other roughly on a center line of a longitudinal axis of shoe 10. However, this line can be off-center. In one embodiment, fingers 34 of either the lateral or the medial support segments 28 may span the entire width of the bottom of midsole 50 such that the free ends 62 of medial and lateral support segments 28 are adjacent to each other on a side of midsole 50. The gap width between adjacent fingers 34 can vary, and in some embodiments medial and lateral fingers 34 can abut. One advantage of having independent medial and lateral fingers 34 is that it gives outsole 54 an additional flexural degree-of-freedom. The gaps between adjacent fingers 34 can act as flexure grooves for outsole 54. Like conventional outsoles, outsole 54 can flex about a lateral axis; but due to structures described herein, outsole 54 can also flex about a longitudinal axis in at least the areas where fingers 34 are operative. This provides the wearer with a cushioned system capable of independent left/right flexure as well as fore/aft flexure, somewhat resembling a personal hydraulic system. Outsole 54 can comprise a forefoot portion 64 and a heel portion 68 which are not part of support segments 28, but rather made of conventional materials with conventional techniques. It is also within the scope of the present disclosure to employ support segments 28 from heel to toe.

As can now be appreciated, support segments wrap around the midsole providing a continuous support element that completely envelopes at least a portion of the midfoot region of the wearer's foot. When the wearer tightens the shoelaces, the entire support structure tightens around the periphery of at least the midfoot region of the article of footwear providing an improved level of support and fit.

It should be noted that the terms "first," "second," "upper," "lower" and the like may be used herein to modify various elements. These modifiers do not imply a spatial, sequential, or hierarchical order to the modified elements unless specifically stated.

The foregoing description of the embodiments are presented for purposes of illustration and description. The description is not intended to be exhaustive or to limit the invention to the precise form disclosed, and obviously many modifications and variations are possible in light of the above teachings. For example, although the invention is descried as having support segments extending from both the lateral and medial sides of the upper, it should be understood that it may be desired to have the support segments extend from only one of the medial or lateral sides. In such a case, it may be desirable to have the support segments long enough to extend the entire width of the shoe. It is also contemplated that the support segments may be longer on one side of the shoe than the other. Finally, it is also contemplated that outsole material, such as rubber, may be attached to the support segments using any conventional method of attaching such materials, such as using adhesives or molding. While this invention has been particularly shown and described with reference to preferred embodiments thereof, it will be understood by those skilled in the art that various changes in form and details may be made therein without departing form the spirit and scope of the invention. Thus, the breadth and scope of the present invention should not be limited by any of the above-described exemplary embodiments, but should be defined only in accordance with the following claims and their equivalents.

What is claimed is:

1. A method for producing an article of footwear comprising the steps of:

(a) forming an upper having at least one support segment, wherein said at least one support segment is disposed on one of either the medial or lateral side of said upper, and wherein said at least one support segment terminates in at least one free end;

(b) attaching a midsole to said upper;

(c) wrapping said at least one support segment around at least a portion of said midsole; and (d) securing said free end of said at least one support segment to an outer surface of said midsole, wherein at least a portion of said at least one free end forms a portion of a ground engaging surface of said article of footwear.

2. The method according to claim 1 further comprising injection molding a thermoplastic urethane material on at least a portion of said at least one support segment.

3. The method according to claim 2 wherein said at least one support segment has an upper portion and an outsole portion and said thermoplastic urethane material is injection molded on at least a portion of said outsole portion of said at least one support segment.

4. The method according to claim 3 wherein said thermoplastic urethane material is injection molded on at least a portion of said upper portion of said at least one support segment.

5. The method according to claim 2 further comprising die cutting at least a portion of said at least one support segment.

6. The method according to claim 5 wherein said at least one support segment has an upper portion and an outsole portion and at least a portion of said outsole portion of said at least one support segment is die cut to form a finger shaped projection from said upper portion of said at least one support segment.

7. The method according to claim 6 further comprising forming at least one indentation in said midsole adapted to fit said finger shaped projection from said upper portion of said at least one support segment.

8. The method according to claim 7 further comprising securing said finger shaped projection of said at least one support segment to said indentation in said midsole.

9. An article of footwear comprising:

an upper, wherein said upper further comprises at least one support segment, wherein said at least one support segment is disposed on one of either the lateral or medial side of said upper, wherein said upper and said at least one support segment are monolithic and wherein said at least one support segment terminates in at least one free end; and a midsole attached to said upper;

wherein said at least one support segment wraps around at least a portion of said midsole so that said free end is secured to an outer surface of said midsole thereby forming at least a portion of a ground engaging surface of said article of footwear.

10. The article of footwear according to claim 9 wherein a thermoplastic urethane material is injection molded onto at least a portion of said at least one support segment.

11. The article of footwear according to claim 10 wherein said at least one support segment has an upper portion and an outsole portion and said thermoplastic urethane material is injection molded on at least a portion of said outsole portion of said at least one support segment.

12. The article of footwear according to claim 11 wherein said thermoplastic urethane material is injection molded on at least a portion of said upper portion of said at least one support segment.

13. The article of footwear according to claim 9 wherein said at least one support segment has an upper portion and an outsole portion and at least a portion of said outsole portion of said at least one support segment is die cut to form a finger shaped projection from said upper portion of said at least one support segment.

14. The article of footwear according to claim 13 wherein said midsole further comprises at least one indentation adapted to fit said finger shaped projection from said upper portion of said at least one support segment and said finger shaped projection of said at least one support segment is secured to said indentation in said midsole.

15. The article of footwear according to claim 13 wherein said finger shaped projection from said upper portion of said at least one support segment wraps around at least a portion of a bottom surface of said midsole.

16. The article of footwear according to claim 15 wherein said finger shaped projection from said upper portion of said at least one support segment wraps around the entire bottom surface of said midsole.

17. The article of footwear according to claim 9 further comprising a shoelace eyestay extending through a top portion of said at least one support segment.

18. The article of footwear according to claim 9 wherein said upper comprises at least one support segment on each of the lateral and medial side of said upper, wherein each support segment terminates in at least one free end and said free ends of said medial and said lateral support segments are adjacent each other along the longitudinal axis of said midsole.

19. The article of footwear according to claim 18 wherein said free ends of said medial and said lateral support segments are adjacent each other along a side of said midsole.

20. A method for producing an article of footwear comprising the steps of:

(a) forming an upper having at least one support segment extending from said upper, wherein said at least one support segment is disposed on one of either the lateral or medial side of said upper, and wherein said at least one support segment terminates in at least one free end;

(b) securing abrasive resistant material to at least a portion of said support segment;

(c) attaching said upper to a midsole, said midsole having a lower surface; and (d) attaching said at least one free end to said lower surface of said midsole.

* * * * *